US006563065B1

(12) United States Patent
Schrammek et al.

(10) Patent No.: US 6,563,065 B1
(45) Date of Patent: May 13, 2003

(54) METHOD OF ADJUSTING AN ELECTRICAL SWITCH ARRANGEMENT

(75) Inventors: Manfred Schrammek, Hösbach (DE); Michael Christ, Hergenfeld (DE); Guido Hirzmann, Sailauf (DE)

(73) Assignee: TRW Automotive Safety Systems GmbH & Co. KG, Aschaffenburg (DE)

( * ) Notice: Subject to any disclaimer, the term of this patent is extended or adjusted under 35 U.S.C. 154(b) by 0 days.

(21) Appl. No.: 09/300,806

(22) Filed: Apr. 27, 1999

(30) Foreign Application Priority Data

Apr. 28, 1998 (DE) ..... 298 07 643 U

(51) Int. Cl.[7] ..... H01H 1/34

(52) U.S. Cl. ..... 200/249; 200/275; 29/622; 29/872; 29/882

(58) Field of Search ..... 29/876, 882, 872, 29/622, 610.1; 260/275, 249

(56) References Cited

U.S. PATENT DOCUMENTS 4,788,763 A * 12/1988 Fisher ..... 29/622
5,813,117 A * 9/1998 Natali ..... 29/874
5,845,766 A * 12/1998 Sako et al. ..... 29/622

FOREIGN PATENT DOCUMENTS

JP 64-2225 * 1/1989 ..... 29/622

* cited by examiner

*Primary Examiner*—Carl J. Arbes
(74) *Attorney, Agent, or Firm*—Tarolli, Sundheim, Covell & Tummino L.L.P.

(57) ABSTRACT

A method of adjusting an electrical switch arrangement comprising a pair of electrical contact members to a predetermined contact spacing is suggested. A first one of the contact members is associated with a first contact carrier and a second one of the contact members is associated with a second contact carrier. The first and second contact members are normally spaced from each other by the predetermined contact distance and are movable relative to each other across the contact distance. At least one of the contact members is displaceably held on the associated contact carrier. The contact carriers are moved towards each other across the predetermined contact distance. The one of the contact members is displaced relative to the associated contact carrier into physical contact with the other of the contact members. The one contact member is fixed in position on the associated contact member while physically contacting the other of the contact members.

3 Claims, 2 Drawing Sheets

METHOD OF ADJUSTING AN ELECTRICAL SWITCH ARRANGEMENT

FIELD OF THE INVENTION

The invention relates to a method of adjusting an electrical switch arrangement.

BACKGROUND OF THE INVENTION

Setting specified, predetermined contact spacings is often possible not before final assembly, because in manufacturing the components involved and in module preassembly dimensional deviations may be maintained only within the scope of permissible tolerances which in the best case may cancel each other out, but which in the worst case may accumulate and result in prohibitively high deviations from the predetermined contact spacing. The contacts for actuating the horn in motor vehicles are usually accommodated in the steering wheel and spaced away from each other by a given dimension so that vibrations stemming from uneven road surface negotiation or from the power train cannot result in an unwanted horn signal. To activate the horn signal the driver needs to press a self-returning button means which is movable by at least the contact travel relative to the steering wheel and is otherwise configured connected to the steering wheel, however. It requires no further explanation to understand that the movement; clearance of the button means cannot just be just selected at random, since the design complications in this respect need to remain within a reasonable scope and since activation of the horn signal must not be delayed by too long a reaction travel. On the other hand, if the movement clearance of the button means is smaller than the contact spacing no horn signal may be activated. From all of the above it materializes that only minor deviations from a predetermined contact spacing are admissible and that setting the contact spacing in final assembly is a mandatory requirement.

The object of the invention is to propose a means of setting the contact spacing which, on the one hand, is extremely reliable and, on the other, is achievable at little expense.

To achieve this object a method of adjusting an electrical switch arrangement comprising a pair of electrical contact members to a predetermined contact spacing is proposed. A first run of the contact members is associated with a first contact carrier and a second one of the contact members is associated with a second contact carrier. The first and second contact members are normally spaced from each other by the predetermined contact distance and are movable relative to each other across the contact distance. At least one of the contact members is displaceably held on the associated contact carrier. The contact carriers are moved towards each other across the predetermined contact distance. The one of the contact members is displaced relative to the associated contact carrier into physical contact with the other of the contact members. The one contact member is fixed in position on the associated contact member while physically contacting the other of the contact members.

The gist of the invention is based on the consideration that no attempt is made to obtain a specified contact spacing in preassembly, but instead, at the most, a rough approximation enabling the predetermined contact spacing to be set in final assembly at little expense. In accordance with one preferred embodiment it is provided for that the one contact member has a polygonal cross-sectional shape. The one contact member is maintained axially shiftable in a matching polygonal recess of the movable associated contact carrier and may be axially secured in the associated contact carrier with an interlocking fit by being turned about its longitudinal axis. Thereby the one contact member and/or the associated contact carrier are plastically deformed. In assembly the associated contact carrier is moved from a rest position into a working position by the predetermined contact spacing, after which the polygon is advanced relative to the associated contact carrier until it comes into contact with the mating contact member before finally being defined by being rotated about the longitudinal axis in the associated contact carrier. If the polygon was inserted too far in the direction of the mating contact member on preassembly in the associated contact carrier, it is automatically shifted back into the correct position relative to the associated contact carrier when the associated contact carrier is displaced from the rest position into the working position and may then be positively defined. It will readily be appreciated that only a very rough approximation to the desired contact spacing is necessary with the one contact member initially maintained axially shiftable and that the desired precise contact spacing can easily be achieved in final assembly by turning the polygon relative to the associated contact carrier.

Expedient further embodiments and variants of the gist of the invention read from the sub-claims 3 to 9.

BRIEF DESCRIPTION OF THE DRAWING

Further details will now be discussed by way of embodiments as shown in FIGS. 1*a*–4 in which.

DESCRIPTION OF PREFERRED EMBODIMENTS

Figure 1A:
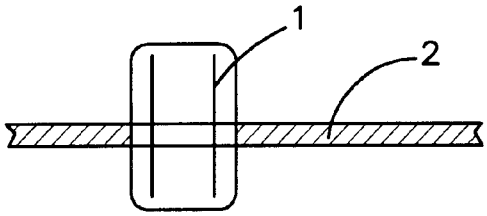
FIG. 1*a* is a sectional view of an embodiment incorporating a polygonal member.
Figure 1B:
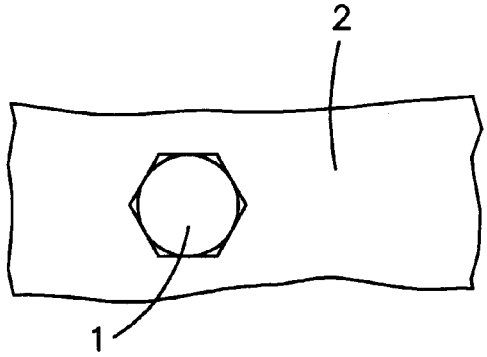
FIG. 1*b* is a plan view of the embodiment shown in FIG. 1*a;*
Figure 1C:
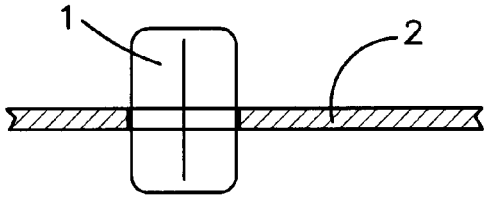
FIG. 1*c* is a sectional view of the embodiment of FIG. 1*b* in which the polygonal member has been turned 30°.
Figure 1D:
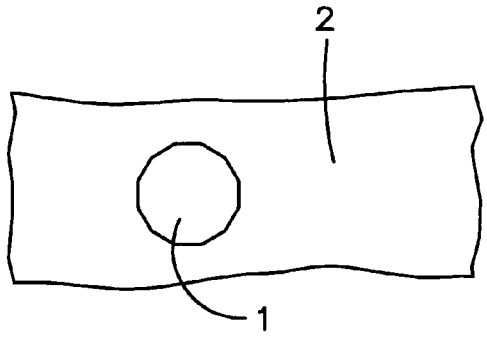
FIG. 1*d* is a plan view of the embodiment shown in FIG. 1*c;*
Figure 1E:
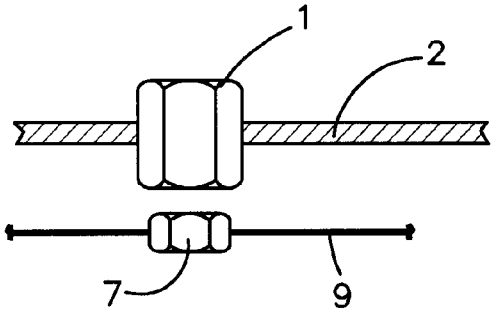
FIG. 1*e* is a schematic representation of a sectional view of an embodiment incorporating a polygonal member and a mating polygonal member.

Referring now to FIGS. 1*a*–1*d* there is illustrated embodiments in which the contact member 1 configured cross-sectionally hexagonal is held axially shiftable in a hexagonal recess of the contact carrier 2, whereby the clamping effect needs to be at least sufficient so that the contact member 1 cannot accidentally drop out of the contact carrier 2. In FIGS. 1*c*–1*d*, the contact member 1 is depicted turned roughly through 30° about its longitudinal axis and thereby positively defined axially relative to the contact carrier 2, it being possible by suitably selecting the materials to ensure that a plastic deformation occurs at contact member 1 and/or at the movable contact carrier 2. In FIG. 1*e*, a schematic representation is shown of the polygonal contact member 1 and contact carrier 2 and a mating polygonal contact member 7 and contact carrier 9.

Figure 2:
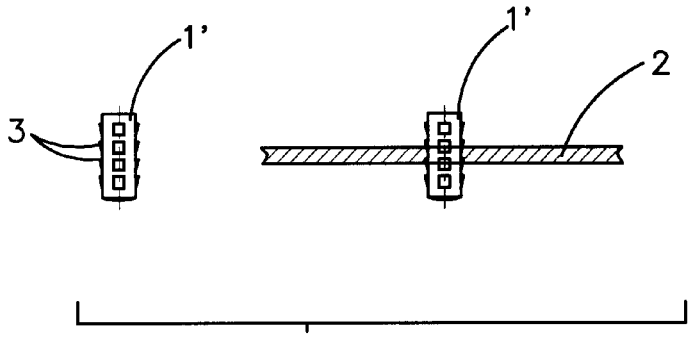
FIG. 2 illustrates an embodiment incorporating a contact member in the shape of a circular component having a hook-shaped protuberances.

Referring now to FIG. 2 there is illustrated an embodiment in which the one contact member 1' is configured circular-cylindrical and oversized to be a press-fit in the movable contact carrier 2. By pressing it further relative to the contact carrier, the contact member 1' is non-positively definable in the desired final position axially non-shiftable. In this embodiment presetting the contact needs to be done—especially when hook-shaped protuberances are provided in addition to the combined positive and non-positive axial location at the circular-cylindrical contact member 1'—so that the contact member 1' needs to be depressed further relative to the contact carrier 2 as shown in the sectioned illustration, there being no means of correcting the contact spacing in the opposite direction.

Figure 3A:
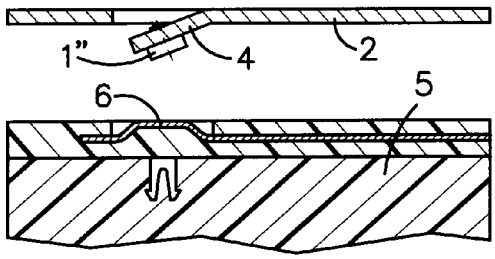
FIGS. 3*a* and *b* illustrate an embodiment incorporating a portion configured readily deformable, maintaining the contact member fixedly in place.
Figure 4A:
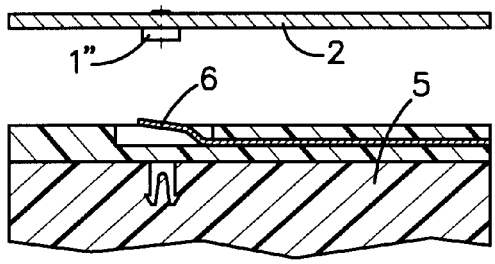
FIGS. 4*a* and *b* illustrate an embodiment incorporating a plastically deformable portion for configuring the mating contact member.
Figure 3B:
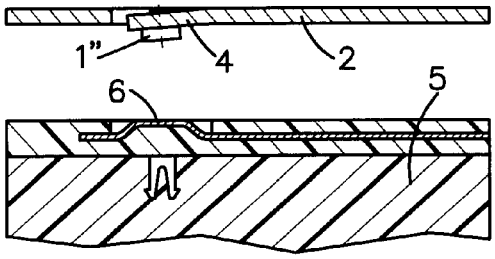
Figure 4B:
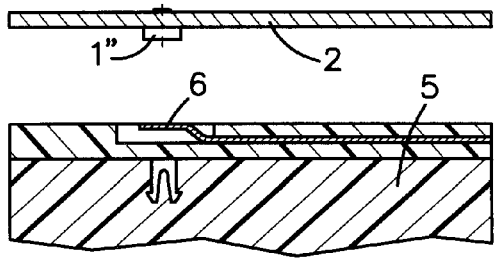

Referring now to FIGS. 3*a* and *b* there is illustrated an embodiment in which the contact member 1" is held axially non-shiftable in the contact carrier 2 and the portion 4 of the movable contact carrier 2 holding the contact member 1" is configured readily plastically deformable to facilitate setting the desired contact spacing. In assembly the contact carrier 2 is moved from a rest position into a working position and then it is made sure that the contact member 1" contacts the mating contact member 6 in the stationary contact carrier 5. In this arrangement the portion 4 is configured so that it is readily pivotable up and down relative to the contact carrier 2, this pivot action in any case involving a permanent, i.e. plastic change in shape.

Similarly, setting the contact spacing may also be configured via a plastically deformable portion 6 of the mating contact member. In this case too, the movable contact carrier 2 is moved with the contact member 1" firmly anchored therein from a rest position into a working position and then ensuring by plastic deformation that the contact member 1", kisses the mating contact member 6. In this case, the plastic deformation of the mating contact member 6 may occur in both directions.

It will be appreciated that the adjuster in accordance with the invention is not restricted to the embodiments as discussed, i.e. variants and alternatives of the design means as described being readily available to the person skilled in the art which permit setting the contact spacing in final assembly at similarly little expense.

What is claimed is:

1. An electrical switch arrangement with an adjustable contact spacing between two electrical contacts, said switch arrangement comprising a pair of electrical contact members, a first one of said contact members having a longitudinal axis land a hexagonal cross-section and being associated with a first contact carrier, a second one of said contact members being associated with a second contact carrier, said first and second contact members being movable relative to each other across a predetermined contact distance, said first contact member initially being held shiftable with respect to said longitudinal axis in a matching hexagonal recess of said first contact carrier, said second contact member being stationarily arranged on said second contact carrier, said first contact member being shiftable into physical contact with said second contact member when said contact members have been moved relative to each other across said contact distance, said first contact member being axially securable on said first contact carrier while said contact members are physically contacting each other by turning said first contact member about said longitudinal axis, thereby plastically deforming at least one of said first contact member and said first contact carrier, whereby an interlocking fit of said first contact member and said first contact carrier is produced.

2. A method of adjusting an electrical switch arrangement to a predetermined contact spacing between two electrical contacts, said switch arrangement comprising a pair of electrical contact members, a first one of said contact members having a longitudinal axis and a hexagonal cross-section and being associated with a first contact carrier, a second one of said contact members being associated with a second contact carrier, said first and second contact members being movable relative to each other across a predetermined contact distance, said first contact member initially being held axially shiftable in a matching hexagonal recess of said first contact carrier, said method comprising the steps of:

i. moving said contact carriers relatively towards each other across said predetermined contact distance;

ii. displacing said first contact member relative to said first contact carrier into physical contact with said second contact member; and iii. axially securing said first contact member on said first contact carrier while said contact members are physically contacting each other by turning said first contact member about said longitudinal axis to plastically deform at least one of said first contact member a said first contact carrier, whereby an interlocking fit of said first contact member and said first contact carrier is produced.

3. The method as set forth in claim 2, wherein step (iii) further includes an additional securing by one of the steps, consisting of welding and soldering.

* * * * *